United States Patent [19]

Eppink

[11] Patent Number: 4,636,151

[45] Date of Patent: Jan. 13, 1987

[54] DOWNHOLE PROGRESSIVE CAVITY TYPE DRILLING MOTOR WITH FLEXIBLE CONNECTING ROD

[75] Inventor: Jay M. Eppink, Spring, Tex.

[73] Assignee: Hughes Tool Company, Houston, Tex.

[21] Appl. No.: 711,322

[22] Filed: Mar. 13, 1985

[51] Int. Cl.[4] ..... F03C 2/00; F16D 3/04

[52] U.S. Cl. ..... 418/48; 418/182; 464/97

[58] Field of Search ..... 418/48, 182; 175/107; 464/19, 97, 182

[56] References Cited

U.S. PATENT DOCUMENTS

| | | | |
|---|---|---|---|
| 2,028,407 | 1/1936 | Moineau | 418/48 |
| 2,346,426 | 4/1944 | Hait | 418/182 |
| 2,621,605 | 12/1952 | Mark, Jr. | 418/48 |
| 3,155,187 | 11/1964 | DeLorean | 464/97 |
| 3,340,814 | 9/1967 | Streicher | 418/48 |
| 3,600,113 | 8/1971 | Pahl et al. | 418/48 |
| 3,612,734 | 10/1971 | Dawson et al. | 418/48 |
| 3,894,818 | 7/1975 | Tschirky | 418/48 |
| 4,080,115 | 3/1978 | Sims et al. | 418/48 |
| 4,140,444 | 2/1979 | Allen | 418/48 |
| 4,187,918 | 2/1980 | Clark | 175/39 |

FOREIGN PATENT DOCUMENTS

| | | | |
|---|---|---|---|
| 2945858 | 7/1980 | Fed. Rep. of Germany | 418/182 |
| 2084697 | 4/1982 | United Kingdom | 418/48 |

*Primary Examiner*—John J. Vrablik

*Attorney, Agent, or Firm*—H. Dennis Kelly

[57] ABSTRACT

A downhole motor of the progressive cavity, or Moineau, type. The motor has a stator, and a rotor within the stator. The rotor rotates and gyrates in response to fluid flow through the stator. A shaft is located within a housing which is connected to the stator. A flexible rod extends between the rotor and the shaft for translating the rotation and gyration of the rotor to the true rotation of the shaft. The rod has an upset section on each end, and upper and lower connections connect the upset sections of the rod to the rotor and to the shaft. The connections are nonintegral to the rod, and are made of a different material from the rod.

5 Claims, 4 Drawing Figures

DOWNHOLE PROGRESSIVE CAVITY TYPE DRILLING MOTOR WITH FLEXIBLE CONNECTING ROD

BACKGROUND OF THE INVENTION

1. Field of the Invention

This invention relates in general to downhole drilling motors of the progressive cavity type.

2. Description of the Prior Art

Downhole drilling motors have been used for many years in the drilling of oil and gas wells. In the usual case, the shaft of the motor and the drill bit will rotate with respect to the housing of the drilling motor. The housing is connected to a conventional drill string composed of drill collars and sections of drill pipe. The drill string extends to the surface, where it is connected to a kelly, mounted in the rotary table of a drilling rig. Drilling fluid is pumped down through the drill string to the bottom of the hole, and back up the annulus between the drill string and the wall of the bore hole. The drilling fluid cools the drilling tools and removes the cuttings resulting from the drilling operation. If the downhole drilling motor is a hydraulic motor, the drilling fluid also supplies the hydraulic power to operate the motor.

One type of hydraulic downhole motor is the progressive cavity type, also known as the Moineau motor. These devices are well known in the art and have a helical rotor within the cavity of a stator, which is connected to the housing of the motor. As the drilling fluid is pumped down through the motor, the fluid rotates the rotor. As the helical rotor rotates, it also gyrates, or orbits, in the reverse direction relative to its rotation. Some type of universal connection must be used to connect the gyrating rotor to the non-gyrating shaft of the motor.

One type of connector utilizes a pair of universal joints which connect a straight rod to the rotor and to the shaft. The universal sections are designed to take only torsional load. A ball and race assembly is used to take the thrust load. Rubber boots are clamped over the universal sections to keep drilling fluid out of the ball race assembly. Most assemblies of this type also require oil reservoir systems to lubricate the ball race and universal joints. Problems exist with the rubber boot systems. Boots may loosen and come off, allowing drilling fluid to enter and wear out the ball race assembly. That forces the universal joints to take torsional and trust loads, causing premature failure. Other motors have had long, flexible shafts, which flex to compensate for the gyration of the rotor. However, when these shafts are long enough to provide sufficient flexing, the overall length of the motor is excessive. A need existed for a connecting rod which was sufficiently flexible, without being excessively long.

SUMMARY OF THE INVENTION

In a downhole drilling motor of the progressive cavity type, the rotor is connected to the shaft by a connecting rod assembly. An upper connection is nonintegral to, but connected to the upset section of a flexible rod, for connecting the rod to the motor. A lower connection is nonintegral to, but connected to the other upset end of the rod, for connecting the rod to the shaft.

The three piece construction of the connecting rod assembly allows the flexible rod and the connections to be made of different materials. Thus, the connections can be large enough for connection to the rotor and to the shaft, and yet the flexible rod can provide adequate flexing in a shorter length. The flexible rod may also be protected by a protective covering.

The above, as well as additional objects, features, and advantages of the invention, will become apparent in the following detailed description.

DESCRIPTION OF THE PREFERRED EMBODIMENT

Figure 1A:
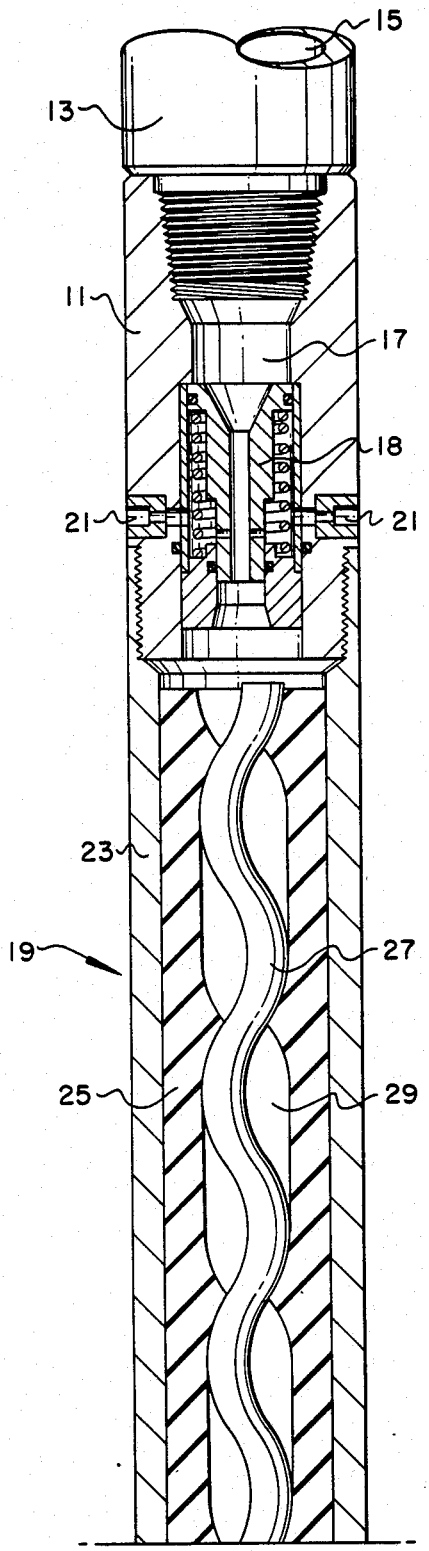
FIGS. 1*a*, 1*b*, and 1*c* are a sectional view, from top to bottom, of a drilling motor according to the invention.

Referring first to FIG. 1*a*, a bypass valve 11 is shown connected to the lower end of a drill string 13. The drill string 13 consists of drill collars and sections of drill pipe, and extends upward through the well bore to a drilling rig at the surface. Drilling fluid, or mud, is pumped downward through the bore 15 of the drill string 13 into the bore 17 of the bypass valve 11, forcing a shuttle 18 downward to close off bypass ports 21 and to direct the drilling fluid downward into a downhole drilling motor 19. The bypass ports 21 allow drilling fluid to exit from the bore 15 of the drilling string 13 when tripping out of the hole, and to fill the bore 15 of the drilling string 13 when tripping into the hole.

The housing of the downhole drilling motor 19 has three parts. The upper housing 23 is connected to the lower end of the bypass valve 11, and houses the progressive cavity motor. The progressive cavity motor has a flexible stator 25, which is connected to the upper housing 23, and a helical rotor 27. The drilling fluid flows downward through the cavities 29 between the stator 25 and the rotor 27 and causes the rotor 27 to rotate.

Figure 1B:
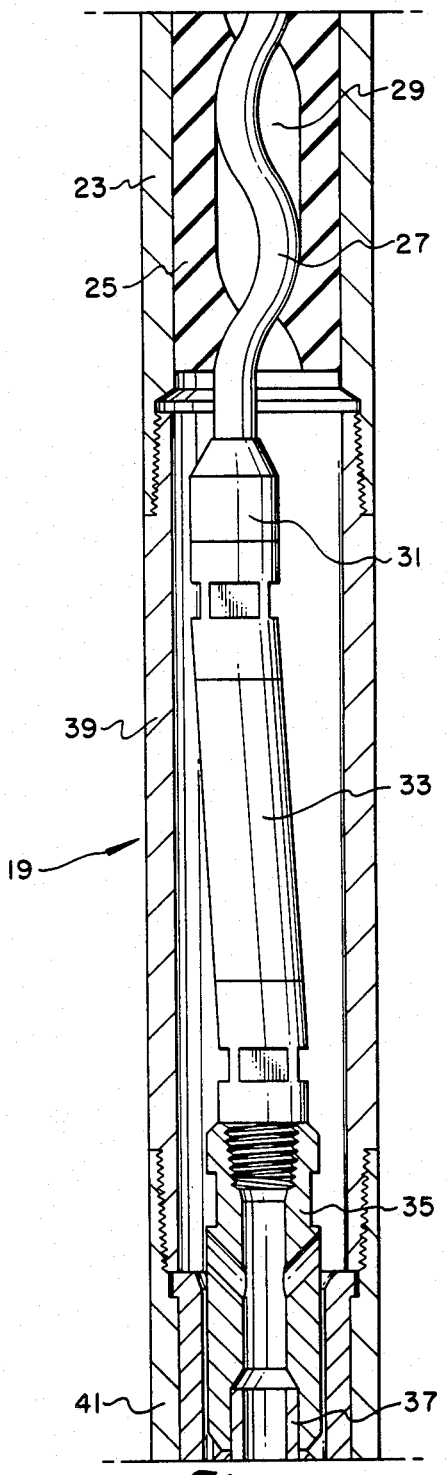

The rotor 27, shown in FIG. 1*b*, gyrates, or orbits, as it rotates. A connecting rod assembly 33 connects the lower end 31 of the rotor 27 to a rotating shaft cap 35 which is firmly connected to the lower end of the upper housing 23 and covers the connecting rod assembly 33. A bearing housing 41 is connected to the lower end of the connecting rod housing 39 and completes the housing of the drilling motor 19. The shaft 37 is concentrically located within the bearing housing 41.

Figure 1C:
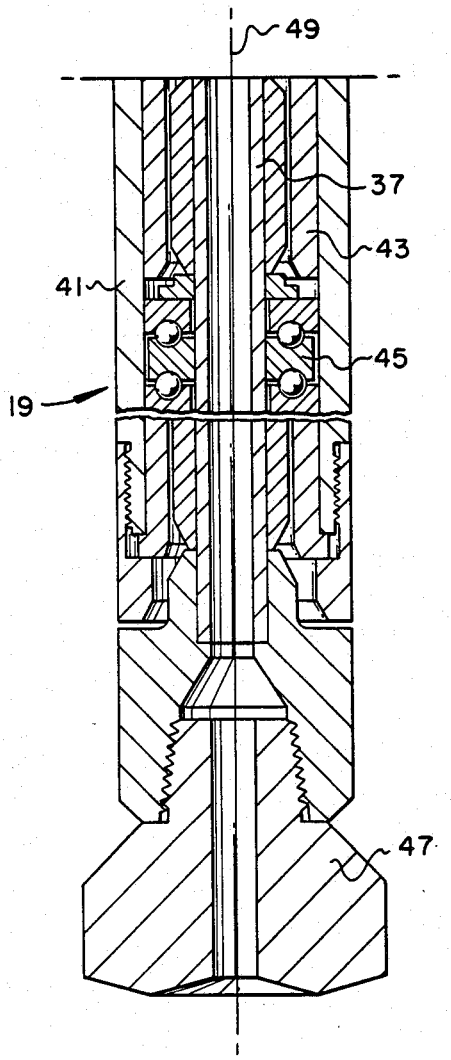

The lower end of the drilling motor 19 is shown in FIG. 1*c*. Various radial bearings 43 and thrust bearings 45 transmit loads between the rotating shaft 37 and the relatively nonrotating bearing housing 41. The rotating shaft 37 is connected to a rock bit 47, which cuts the bore hole as it rotates. In order to drive the rock bit 47 properly, the shaft 37 must rotate with a true rotation about the longitudinal axis 49 of the shaft 37 and the housing 41.

Figure 2:
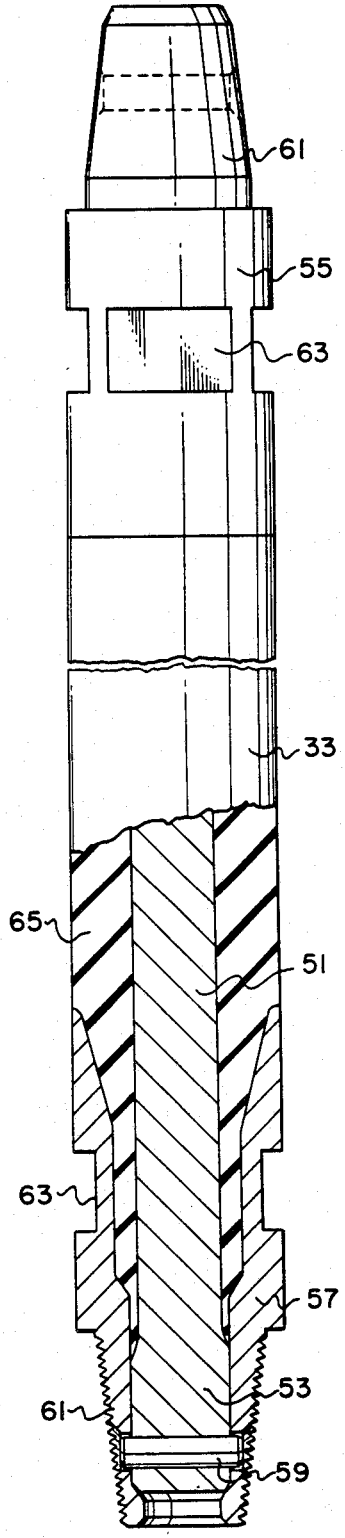
FIG. 2 is a side view, partially in section, of a connecting rod assembly according to the invention.

The connecting rod assembly 33 is shown in greater detail, and partially in section, in FIG. 2. The connecting rod assembly 33 must translate the rotation and gyration of the rotor 27 to the true rotation of the shaft 37. A flexible rod 51 extends from the lower end 31 of the rotor 27 to the upper end 35 of the shaft 37. The flexible rod 51 must withstand the motor thrust and torque loads, and yet be flexible enough to allow for the eccentricity between the rotor 27 and the shaft 37. Each end of the flexible rod 51 has an upset section 53 to reduce stress at the ends, where bending loads are the highest. An upper connection 55 and a lower connection 57 are connected to the upset sections 53 of the flexible rod 51. The connections 55, 57 may be secured to the rod 51 in any of several methods, including interference fit, threads, or pins 59, such as are shown in FIG. 2. The connections 55, 57 have threads 61 for connection to the rotor 27 and to the shaft 37. The connections 55, 57 also have a plurality of machined flats 63 to facilitate assembly of the drilling motor 19.

A covering 65 of rubber or other flexible material is placed around the rod 51 to fill the space between the rod 51 and the connections 55, 57. The covering 65 protects the flexible rod 51 and supports the rod 51 at each end where bending stresses are the highest. The surface of the flexible rod 51 also may be worked, such as by shot peening, or protective coatings may be applied, to increase the life of the flexible rod 51 by reducing surface stresses and by protecting against corrosion and damage due to handling.

During operation, drilling fluid circulates through the drilling motor 19 to rotate the rotor 27. As the rotor 27 rotates, the lower end 31 of the rotor 27 also gyrates or orbits. The connecting rod assembly 33 must translate the rotation and gyration of the rotor 27 to the true rotation of the shaft 37. The flexible rod 51 bends and flexes to compensate for the eccentricity between the rotor 27 and the shaft 37.

The downhole drilling motor 19 of the invention has several advantages over the prior art. Since the connecting rod assembly 33 operates as a unit, there is no wear between the various parts. Since the connecting rod 51 and the connections 55, 57 are not integral, they may be made from different materials. This fact allows for the selection of an optimum material for the flexible rod 51 and for the connections 55, 57. The connecting rod assembly 33 is shorter than the prior art flexible shafts, thus shortening the overall length of the downhole motor 19.

While the invention has been shown in only one of its forms, it should be apparent to those skilled in the art that it is not so limited, but is susceptible to various changes and modifications without departing from the spirit thereof.

I claim:

1. A downhole drilling motor, comprising:

a stator of the progressive cavity type;

a rotor, within the stator, wherein the rotor rotates and gyrates in response to fluid flow through the stator;

a housing, connected to the stator;

a shaft concentrically located within the housing and rotatable about the longitudinal axis of the shaft and the housing;

a plurality of bearings between the housing and the shaft;

a flexible rod, extending between the rotor and the shaft, for translating the rotation and gyration of the rotor to the true rotation of the shaft;

an upper threaded connection, nonintegral to, but connected to one end of the rod, for connecting the rod to the rotor; and a lower threaded connection, nonintegral to, but connected to the other end of the rod, for connecting the rod to the shaft.

2. A downhole drilling motor, comprising:

a stator of the progressive cavity type;

a rotor, within the stator, wherein the rotor rotates and gyrates in response to fluid flow through the stator;

a housing, connected to the stator;

a shaft concentrically located within the housing below the rotor and rotatable about the longitudinal axis of the shaft and the housing;

a plurality of bearings between the housing and the shaft;

a flexible rod, extending between the rotor and the shaft, for translating the rotation and gyration of the rotor to the true rotation of the shaft;

an upper threaded connection, nonintegral to, but connected to one end of the rod, for connecting the rod to the rotor; and a lower threaded connection, nonintegral to, but connected to the other end of the rod, for connecting the rod to the shaft.

3. A downhole drilling motor, comprising:

a stator of the progressive cavity type;

a rotor, within the stator, wherein the rotor rotates and gyrates in response to fluid flow through the stator;

a housing, connected to the stator;

a shaft concentrically located within the housing and rotatable about the longitudinal axis of the shaft and the housing;

a plurality of bearings between the housing and the shaft;

a flexible rod, extending between the rotor and the shaft, for translating the rotation and gyration of the rotor to the true rotation of the shaft, said rod having an upset section at each end;

an upper threaded connection, nonintegral to, but connected to one upset section of the rod, for connecting the rod to the rotor; and a lower threaded connection, nonintegral to, but connected to the other upset section of the rod, for connecting the rod to the shaft.

4. A downhole drilling motor, comprising:

a stator of the progressive cavity type;

a rotor, within the stator, wherein the rotor rotates and gyrates in response to fluid flow through the stator;

a housing, connected to the stator;

a shaft concentrically located within the housing and rotatable about the longitudinal axis of the shaft and the housing;

a plurality of bearings between the housing and the shaft;

a flexible rod, extending between the rotor and the shaft, for translating the rotation and gyration of the rotor to the true rotation of the shaft, said rod having an upset section at each end;

an upper threaded connection, nonintegral to, but connected to one upset section of the rod, for connecting the rod to the rotor;

a lower threaded connection, nonintegral to, but connected to the other upset section of the rod, for connecting the rod to the shaft; and a flexible, protective covering around the rod.

5. A downhole drilling motor, comprising:

a stator of the progressive cavity type;

a rotor, within the stator, wherein the rotor rotates and gyrates in response to fluid flow through the stator;

a housing, connected to the stator;

a shaft concentrically located within the housing and rotatable about the longitudinal axis of the shaft and the housing;

a plurality of bearings between the housing and the shaft;

a flexible rod, extending between the rotor and the shaft, for translating the rotation and gyration of the rotor to the true rotation of the shaft, said rod having an upset section at each end;

an upper connection, nonintegral to, but threaded connected to one upset section of the rod, for connecting the rod to the rotor, wherein said upper connection is a different material from the rod; and a lower connection, nonintegral to, but threaded connected to the other upset section of the rod, for connecting the rod to the shaft, wherein said lower connection is a different material from the rod.

* * * * *